United States Patent [19]

Green et al.

[11] 4,375,396

[45] Mar. 1, 1983

[54] THIN WIRE POINTING METHOD

[75] Inventors: James M. Beggs, Administrator of National Aeronautics and Space Administration, with respect to an invention of Gordon Green; Robert J. Mattauch, both of Charlottesville, Va.

[73] Assignee: The United States of America as represented by the Administrator of the National Aeronautics and Space Administration, Washington, D.C.

[21] Appl. No.: 322,316

[22] Filed: Nov. 17, 1981

[51] Int. Cl.[3] ..... C25F 3/02

[52] U.S. Cl. ..... 204/129.55; 204/129.75

[58] Field of Search ..... 204/129.55, 129.75

[56] References Cited

U.S. PATENT DOCUMENTS 2,628,936 2/1953 Albano ..... 204/129.55

3,006,827 10/1961 Capuano ..... 204/129.75 X

*Primary Examiner*—G. L. Kaplan

*Assistant Examiner*—Nam X. Nguyen

*Attorney, Agent, or Firm*—Paul F. McCaul; John R. Manning; Thomas H. Jones

[57] ABSTRACT

A method is described for forming sharp tips on thin wires, in particular phosphor bronze wires of diameters such as one-thousandth inch used to contact micron size Schottky barrier diodes, which enables close control of tip shape and which avoids the use of highly toxic solutions. The method includes dipping and end (12) of a phosphor bronze wire (14) into a dilute solution (16) of sulfamic acid and applying a current through the wire to electrochemically etch it. The humidity in the room is controlled to a level of less than 50%, and the voltage applied between the wire (14) and another electrode (18) in the solution is a half wave rectified voltage. The current through the wire is monitored, and the process is stopped when the current falls to a predetermined low level.

7 Claims, 4 Drawing Figures

FIG. 1
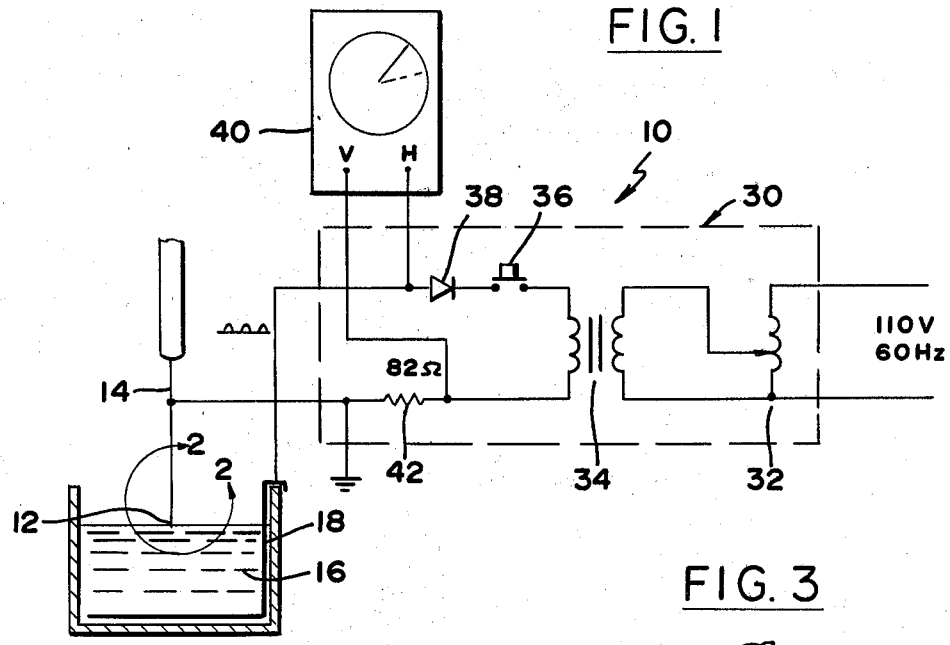
FIG. 3
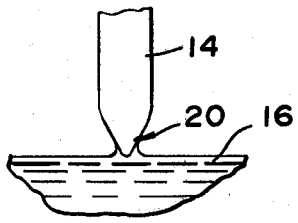
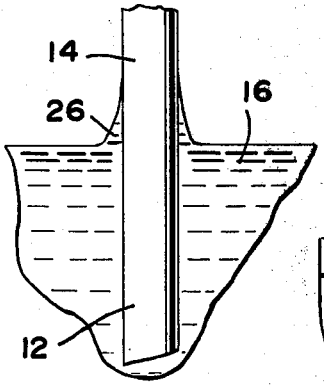
FIG. 2
FIG. 4
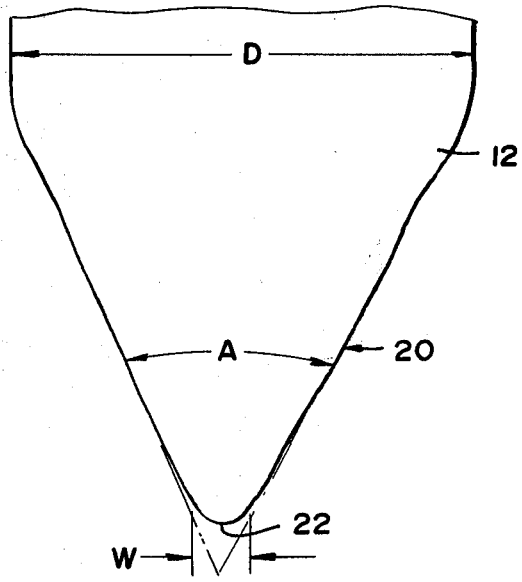

THIN WIRE POINTING METHOD

ORIGIN OF THE INVENTION

The invention described herein was made in the performance of work under a NASA contract and is subject to the provisions of Section 305 of the National Aeronautics and Space Act of 1958, Public Law 85-568 (72 Stat. 42 USC 2457).

BACKGROUND OF THE INVENTION

A pointed metal wire of a diameter in a range from 12 to 50 micrometer (0.5 to two thousandths inch) is often used to contact a micron size Schottky barrier metal anode. The extreme tip of the wire must have a small radius of curvature, and certain high frequency (above 100 GHz) applications also require a given cone angle at the tip for electrical and mechanical reasons. Materials commonly used in the wires or whiskers for high frequency applications, are gold and its alloys, phosphor bronze, and tungsten. Stress relieved grade C phosphor bronze wire is especially useful as a contact whisker material for high frequency applications, because of its high mechanical strength and springiness.

One technique for forming a pointed phosphor bronze wire or whisker of the desired cone angle and extreme tip diameter or radius involves electrochemical etching in chromium trioxide. Since chromium and its compounds are extremely toxic, there is considerable need for a less objectionable pointing solution. A pointing technique which avoided the use of highly toxic mateials and which enabled the pointing of wires of controlled cone angle and extreme tip diameter, would be of considerable value.

SUMMARY OF THE INVENTION

In accordance with one embodiment of the present invention, a method is provided for the pointing of fine wires. The end of the wire is dipped into an electrolytic solution and current is applied through the wire and solution to electrochemically etch the wire. In the etching of phosphor bronze wire, an aqueous sulfamic acid solution is utilized as the electrolyte. The etching can be controlled by applying a predetermined voltage across the wire-electrode system monitoring the current and stopping the etching operation when the current drops to a predetermined level. The humidity in the environment can be controlled at a level of less than 50% to increase the reliability of pointing. The applied current can be a substantially half wave rectified sinusoidal current, which is found to provide more reliable control of the point.

The novel features of the invention are set forth with particularity in the appended claims. The invention will be best understood from the following description when read in conjunction with the accompanying drawings.

BRIEF DESCRIPTION OF THE DRAWINGS

FIG. 1 is a simplified side elevation and schematic view of a pointing method conducted in accordance with the present invention.

FIG. 2 is an enlarged view of the area 2—2 of FIG. 1.

FIG. 3 is a view similar to FIG. 2, but shown at the end of the electrochemical etching step.

FIG. 4 is an enlarged view of the final wire or whisker tip produced by the method of the invention.

DESCRIPTION OF THE PREFERRED EMBODIMENTS

FIG. 1 illustrates a system 10 which is used to form a point at the end portion 12 of a wire 14. The wire end portion 12 is dipped into a bath 16 of an electrolyte, and a current is passed through the wire and the electrolyte to electromechanically etch the wire end portion 12. This is done by applying a voltage between the wire 14 and a platinum or other electrode 18 which is immersed in the solution. The process can be conducted to closely control the shape of the final wire end, to enable its use as an element for contacting the anode of a micron size Schottky diode or making other contacts in micron size areas.

FIG. 4 shows the shape of the tip 20 required at the end portion 12 of the wire, to enable its use as a contact. The curvature, or radius of curvature of the extreme tip 22 and its width W along which it is curved should be small such as 1/10th the diameter D of the wire and should be relatively uniform all about the wire, to make reliable contact with the anode of the Schottky diode over a small area. In addition, certain high frequency applications where the Schottky diode is operated above 100 GHz, require close control of the cone angle A of the tip, to an angle such as about 60°. In most applications the cone angle must not be too small or the tip end may collapse. Since the wire diameter D is small, between about 12 to 50 micrometer (about 0.5 to 2 thousandths inch) it can be difficult to control the shape of the tip.

FIG. 2 shows a first step in the process conducted with the equipment of FIG. 1, wherein the end portion 12 of the wire has been dipped into the electrolyte 16. The wire is initially immersed to a length of about five times its diameter, or about 125 micrometer for a wire of 25 micrometer diameter. The electrolyte 16 is hydrophilic to the wire, that is, the electrolyte forms a meniscus 26 about the wire. It is believed that the meniscus 26 has an important effect on the formation of the tip, by allowing progressively greater etching rates at progressively lower levels along the meniscus, to produce the moderate cone angle of the tip. FIG. 3 shows the wire end portion 12 at the end of electrochemical etching, wherein the tip 20 has been formed to the shape shown in FIG. 4. At this time, electrochemical etching is stopped and the wire is rinsed, dried, and observed under a microscope to check the form of the tip.

Previous pointing of phosphor bronze wires has been accomplished by electrochemical etching of the wire in a solution containing chromium trioxide, which is extremely toxic. It has been found that well formed wire tips can be consistently produced using an electrolyte 16 which is an aqueous sulfamic acid solution. A solution which has been found to produce good results includes 4% sulfamic acid crystals ($H_2NSO_3H$) by weight dissolved in deionized water. Sulfamic acid is used chiefly as a weed killer, in cleaning metals, and in the form of salts as a flame proofing or softening agent for papers and textiles. Its relatively low toxicity allows the pointing method to be carried out without extreme precautions against poisoning. A variety of other electrolytes have been tried, but they resulted in a wire point that is too blunt, or which is concavely tapered, or which has a rough surface. Also, a variety of sulfamic acid concentrations were tried, ranging from under 1% of sulfamic acid crystals by weight in water, to a saturated solution of about 50% sulfamic acid crystals, but a solution of about 4% was found to produce the best results.

The system 10 used for pointing the wire 14, includes a current source 30 which produces a half wave rectified output of constant peak voltage. The particular source 30 includes a pair of transformers, including a first one 32 connected to a 110 volt 60 Hz power outlet to provide an adjustable voltage, and another one 34 which provides a voltage stepdown. The output of the second transformer 34 is connected through a switch 36 and a diode 38 to the immersed electrode 18 and to the wire. The output of the voltage source 30 is a halfwave rectified sinusoidal voltage. Various voltage devices have been tried, including those that produce substantially ripple-free DC, sinusoidal AC, and full wave rectified AC, as well as the half wave rectified AC. Of all of these, the half wave rectified AC output has been found to provide more consistent wire tip shapes.

It is important to determine precisely when the electrochemical etching process should be halted. This is accomplished by monitoring the current flowing through the wire, which is found to rapidly decrease as electrochemical etching progresses, and by ceasing the process when the voltage reaches a predetermined level. In the system of FIG. 1, the output of the voltage source 30 had a peak voltage of 17 volts, which resulted in a peak current through the wire 14 of about 5 milliamperes at the beginning of the process. After about 5 seconds, the current had dropped to about 1 milliampere and the process was then stopped. A switch 36 was initially closed to begin current flow and the switch was opened as soon as the predetermined current level was reached. An oscilloscope 40 was used to monitor the pointing cell voltage and current, with the horizontal input to the oscilloscope connected to the high side of the voltage source 30 and with the vertical input connected across a current sensing resistor 42 on the low side. In FIG. 1, the screen of the oscilloscope 40 shows in solid lines the display at the beginning of the process, and in phantom lines the display at the end of the process.

It has been found that the moisture in the environment around the electrolyte bath 16 affects the wire pointing process. When the humidity is relatively high, the point shape is not as consistent as when the humidity is low. A relative humidity of less than about 50% is desirable. In tests that were conducted, the humidity in a room environment was reduced by using a dehumidifier and an air conditioner to lower the relative humidity, although the minimum obtained was about 40% when the outdoor humidity was high. It is believed that the low humidity is useful in controlling the meniscus 26 about the end portion of the wire, as by permitting evaporation of the upper end of the meniscus to produce a wide cone angle in the tip. Of course, most of the weight and volume of the electrolyte is water, so that moisture in the air affects the vaporization rate of the water. While acceptable results have been obtained even at high humidity levels considerably above 50%, it is found that lower humidity levels significantly improve the reliability of the process.

Thus, the invention provides a method for forming points or tips of controlled shape at the ends of thin wires, and especially of phosphor bronze wires. This can be accomplished by electrochemical etching, using an aqueous sulfamic acid solution as the electrolyte. Control of the length of the etching process can be determined by monitoring the current flowing through the wire as a voltage is applied, between an electrode in the solution and the wire, that is constant (the peak in each voltage cycle is the same, and the cycle time is orders of magnitude smaller than the process time). The electrochemical etching is stopped when the current falls to a predetermined level. The current is preferably a half wave rectified current. Control of the humidity in the environment to a low level that is preferably below 50%, further enhances the reproducibility of the process.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A method for pointing phosphor bronze wire comprising:

dipping an end portion of a wire to be pointed in an electrolyte, and passing current between said wire end portion and said electrolyte;

said wire formed of phosphor bronze, and said electrolyte consisting substantially of sulfamic acid diluted in water.

2. The method described in claim 1 including:

maintaining the humidity in the region above said electrolyte below 50%.

3. The method described in claim 1 wherein:

said step of passing current includes applying a half-wave rectified substantially sinusoidal current to said wire.

4. The method described in claim 1 including:

said step of applying current includes applying a controlled voltage between said wire and an electrode immersed in said electrolyte, monitoring the current passing through said wire, and ceasing the passage of current through said wire when the current falls to a predetermined level.

5. The method described in claim 1 wherein:

said electrolyte consists of about 4% sulfamic acid by weight and about 96% water by weight.

6. A method for pointing a wire, comprising:

immersing an end portion of said wire in a bath of a liquid solution which wets to said wire so that a liquid meniscus forms around the wire and etching away wire material at said meniscus;

said wire is formed of phosphor bronze; and said solution consists of about 4% by weight of sulfamic acid crystals dissolved in water.

7. A method for pointing a wire comprising:

immersing a clean end portion of a phosphor bronze wire in a bath of sulfamic acid;

applying a controlled voltage between said wire and a location of said bath, to electrochemically etch the wire end portion; and monitoring the current passing through said wire, and ceasing the electromechanical etching when the current falls to a predetermined level.

* * * * *